US006508893B2

(12) United States Patent
Eto

(10) Patent No.: US 6,508,893 B2
(45) Date of Patent: Jan. 21, 2003

(54) METHOD OF MANUFACTURING FE-NI ALLOY

(75) Inventor: Masatoshi Eto, Ibaraki-ken (JP)

(73) Assignee: Nippon Mining & Metals Co., Ltd., Ibaraki-ken (JP)

( * ) Notice: Subject to any disclaimer, the term of this patent is extended or adjusted under 35 U.S.C. 154(b) by 0 days.

(21) Appl. No.: 09/942,482

(22) Filed: Aug. 30, 2001

(65) Prior Publication Data

US 2002/0043314 A1 Apr. 18, 2002

(30) Foreign Application Priority Data

Aug. 30, 2000 (JP) ..... 2000-260567

(51) Int. Cl.[7] ..... C21D 7/13; C21D 8/00
(52) U.S. Cl. ..... 148/653; 148/648; 148/621
(58) Field of Search ..... 148/653, 648, 148/336, 621

(56) References Cited

U.S. PATENT DOCUMENTS 5,396,146 A * 3/1995 Nakamura et al. ..... 313/402

FOREIGN PATENT DOCUMENTS

JP 402170922 A * 7/1990 ..... C21D/9/46
JP 406184701 A * 7/1994 ..... C22C/38/00

* cited by examiner

*Primary Examiner*—Deborah Yee
(74) *Attorney, Agent, or Firm*—Jordan and Hamburg LLP

(57) ABSTRACT

A method of manufacturing an improved Fe—Ni alloy consisting of 33–37% Ni; 0.001–0.1% Mn; optionally, 0.01–2% Co; and at least one of (1) 0.01–0.8% Nb; (2) 0.01–0.8% Ta; and/or (3) 0.01–0.8% Hf, with the total of Nb, Ta and Hf being in the range of 0.01–0.8% and the remainder being Fe and unavoidable impurities. The method comprises subjecting the alloy to a hot rolling process wherein the rate of distortion during each pass of hot rolling is below 70/second resulting in the alloy having a reduced rate of crack formation during the hot rolling process, and high drop-shock resistance and low thermal expansion after the hot rolling process.

4 Claims, 1 Drawing Sheet

FORMULA FOR ARC AB = L $$\theta = \cos^{-1}\left(\frac{r - \frac{t0 - t1}{2}}{r}\right) \longrightarrow L = 2\pi r \frac{\theta}{360}$$

ROLLING DURATION: $h = \frac{\text{LENGTH: } L}{\text{VELOCITY: } V}$

DISTORTION $$\varepsilon = \ell n \frac{t0}{t1}$$

DISTORTION RATE $$\varepsilon = \frac{\varepsilon}{h}$$

METHOD OF MANUFACTURING FE-NI ALLOY

BACKGROUND OF THE INVENTION

1. Field of the Invention

The present invention deals with the manufacturing of Fe—Ni alloys used in press molded flat mask cathode-ray tube (CRT) screens. Specifically, by selecting the type and concentration of specific additional elements in the alloy, and by controlling the conditions under which the hot rolling of the alloy is conducted, it is possible to maintain the low thermal expansion and drop-shock resistant characteristics of Fe—Ni alloys while controlling crack formation during the manufacturing process.

2. Description of the Related Art Including Information Disclosed Under 37 CFR 1.97 and 1.98

CRT displays show images on screen by directing electron beams emitted from electron guns onto a fluorescent material placed behind a glass panel. The direction of the electron beams are magnetically controlled by a deflecting yoke. Between the electron gun and the glass panel, a structure is mounted which divides the beams into pixel-point units and directs the beams to the proper fluorescent material. This structure is known as a "mask." Two types of masks are used in CRT displays: shadow masks, which are formed into press molded material which have been etched with dots or slots; and aperture grills, which are constructed by tightly stretching (in a vertical direction) material which have been etched with vertical slots onto supporting frames. Both methods have advantages and disadvantages, and are both commonly used in the current market.

Much effort has been expended toward creating "flat screen" displays that will display the image on a flat surface. By "flat screen" we mean here a display screen that is nearly totally flat as opposed to the traditional curved screen. One of the biggest problems in making flat screens for CRT displays is how to construct shadow masks or aperture grills that are as flat as possible. There are difficult technical problems with each, but basically it is considered more difficult to construct a flat screen by pressing a shadow mask into a flat shape than to construct one through the "hanging" methods used in aperture grills. (e.g., see NIKKEI ELECTRONICS 1999.7.26 (No. 748) p. 128).

This is due to the fact that since shadow masks are constructed by forming press molded metal sheets, unlike with the "frame-hanging" method, the material needs to maintain shape through its own shape maintaining ability. Basically, what this means is that the mask needs to be curved in order to maintain its shape. Therefore it is difficult to maintain the shape in a nearly level state as required for a flat mask. The only way to overcome this problem is to improve the strength of the mask. The "strength" in question here is not the strength of the metal per se (as is measured by tensile testing, for instance), but the strength of the mask after the CRT has been put together as determined by whether or not the shape of the mask is affected when the entire CRT is subjected to shock. Specifically, the CRT is dropped from a certain height to test whether the shape of the mask is affected. The development of masks that are resistant to deformation from this type of shock (drop-shock resistant) is crucial for the production of flat-mask CRTs. It is known that the Young's modulus and proof stress of the mask material most strongly affects the evaluation of drop-shock resistance.

In addition, flat masks are required to have excellent doming properties. That is, as the masks are made flatter, the angles at which the electron beams hit the mask at the four corners become sharper. This means that slight misalignments caused by thermal expansion of the mask cause the beam to be misaligned, leading to color distortion in the displayed image. Therefore there is a need to develop masks with much lower thermal expansion than conventional masks.

The basic material used for shadow masks has been Fe—Ni (33–37%) alloy with added Mn. The ease with which Fe—Ni alloy can be hot worked is greatly affected by the amount of S contained in the alloy. The greater the amount of S, the less workable the alloy is. In order to counter the effect of S within the alloy on its workability, it is effective to add Mn to the alloy, causing the S within the alloy to chemically combine with the Mn to form MnS. In general, the greater the ratio of Mn to S within the alloy, the greater the improvement in hot workability; a ratio of at least 50–100 Mn/S is needed. Mn also serves as a deoxidization agent. However the addition of Mn increases the thermal expansion coefficient. For flat masks, an average thermal expansion coefficient of below $12\times10^{-7}$/° C. at 30–100° C. must be achieved.

Thus, in a press molded shadow mask, much lower thermal expansion and higher drop-shock resistance is required than in conventional masks. Therefore, there has been previously disclosed in patent application JP2000-192249, an Fe—Ni alloy designed to decrease the amount of added Mn and obtain a high proof stress, namely an Fe—Ni alloy to which Co is added in appropriate amounts as needed in relation to the amount of Ni, with Nb, Ta and Hf added as appropriate, while limiting the amount of impurities in the alloy. Such alloy contains 33–37% Ni; 0.001—0.1% Mn; optionally 0.01–2% Co; and at least one of (1) 0.01–0.8% Nb; (2) 0.01–0.8% Ta; and/or (3) 0.01–0.8% Hf, with the total of Nb, Ta, and Hf being in the range of 0.01–0.8%.

However, although the above-mentioned alloy possesses characteristics making it suitable for use in flat masks, because the amount of Mn is limited to the low level of 0.001–0.1%, and despite limiting the amount of S in the alloy to below 0.002%, such alloy has a propensity toward developing edge and surface cracks while undergoing hot rolling during manufacture. In addition, it has been noted that the inclusion of Nb, Ta and Hf, which increases drop-shock resistance, also contributes to diminished workability, leading to an increase in edge and surface crack formation.

The purpose of the current invention is to find the conditions for hot rolling which will limit the development of edge and surface crack formation in the aforementioned alloy during hot rolling.

BRIEF SUMMARY OF THE INVENTION

Having analyzed conditions leading to decrease of edge and surface crack formation in the aforementioned alloy, it has been concluded that the distortion rate within each pass of hot rolling is especially crucial, and furthermore that the heating conditions prior to hot rolling and the temperature at the completion of hot rolling are also important.

The present invention provides a method of manufacturing an improved Fe—Ni alloy consisting of 33–37% Ni; 0.001–0.1% Mn; optionally 0.01–2% Co; and at least one of (1) 0.01–0.8% Nb; (2) 0.01–0.8% Ta and/or (3) 0.01–0.8% Hf, with the total of Nb, Ta and Hf being in the range of 0.01–0.8%, and the remainder being Fe and unavoidable impurities. The method comprises subjecting the alloy to a hot rolling process wherein the rate of distortion during each pass of hot rolling is below 70/second resulting in the alloy having a reduced rate of crack formation during the hot rolling process as well as high drop-shock resistance and low thermal expansion after the hot rolling process. Preferably the main impurities in the alloy are limited to maximums of 0.01% C, 0.02% Si, 0.01% P, 0.01% S and 0.005% N.

Also preferred as part of the manufacturing process of this invention is heating the alloy at a temperature of 1000 to 1300° C. for 0.5 to 10 hours before hot rolling, and performing the final pass of hot rolling at a temperature of the alloy above 600° C.

BRIEF DESCRIPTION OF THE DRAWING

The drawing is an explanatory diagram of how to measure hot rolling distortion.

DETAILED DESCRIPTION OF THE INVENTION

Figure 1:
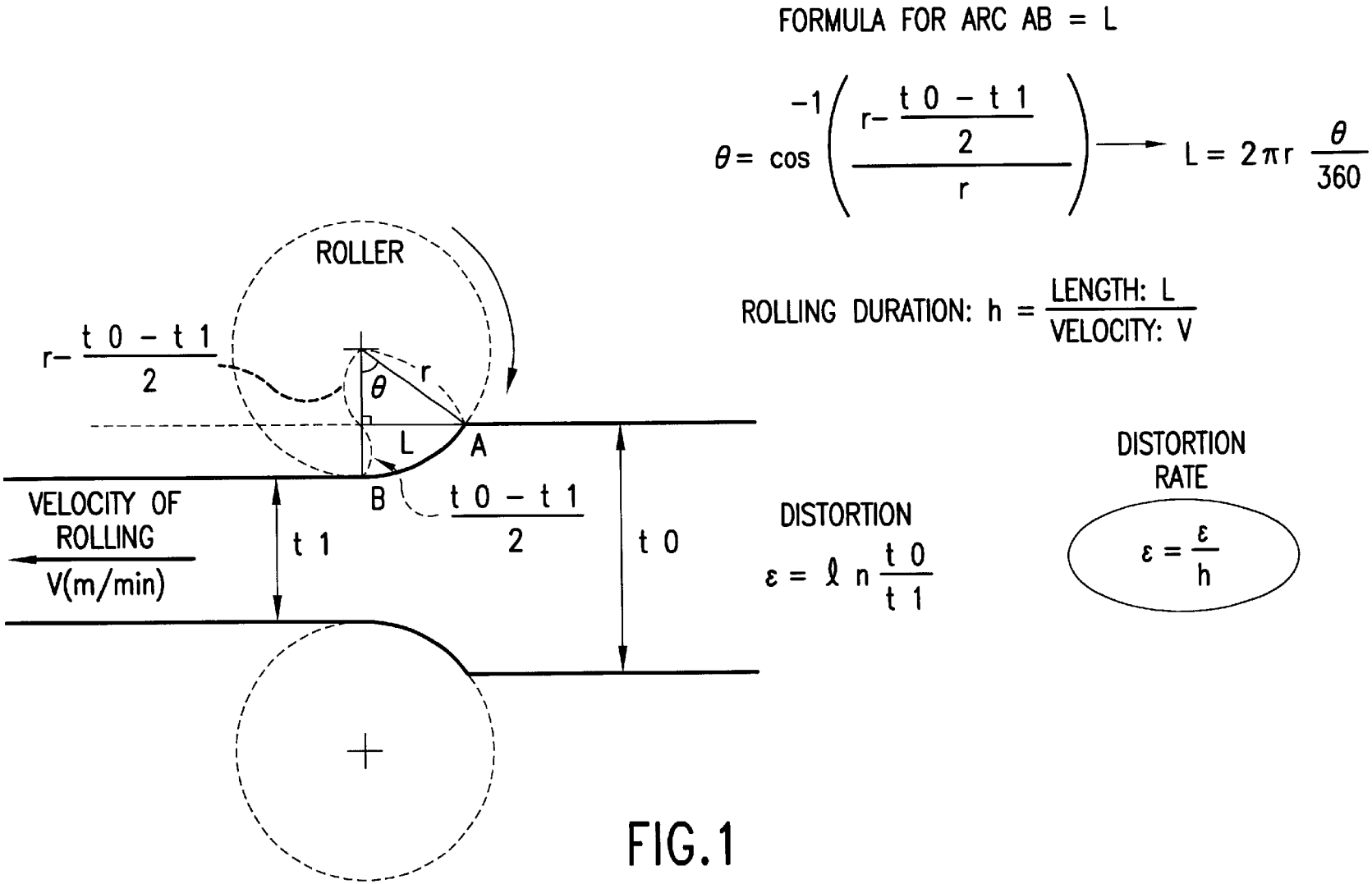

Shadow masks are manufactured by melting an alloy of the specified composition in, for example, a vacuum induction furnace (VIM), and after the alloy is cast into ingots, it is then, for example, forged, and hot rolled into coils approximately 3 mm thick through multiple passes from an initial thickness of, for example, 150 mm. Afterwards the material is processed into sheets approximately 0.1–0.25 mm thick by repeated cold rolling and bright annealing, and slitted into a specified width to form the base material for shadow masks. The base material is then degreased, and photoresist is applied to both sides. Then a pattern is burned on and developed, and holes are etched into the material, after which the material is cut into individual shadow mask base units. These base units are annealed in a deoxidization atmosphere, for instance, a reduction atmosphere (900° C.×30 minutes, in hydrogen), then press molded. (In a pre-anneal method, the annealing is conducted before the etching after the last pass of cold rolling.) If necessary, the base units undergo leveling, and are then shaped into almost totally flat "flat masks". Finally the press molded flat masks are degreased and then blackened in a standard atmosphere or a $CO/CO_2$ atmosphere.

The press molded "flat mask" which can be produced by means of the current invention possesses a nearly totally flat shape of, for instance, outside surface curvature radius R of above 100,000 mm and a degree of flatness (ratio of maximum height of curved screen area/diagonal length of usable screen surface) below 0.1%. Such press molded "flat mask" possesses a Young's modulus of above 120,000 $N/mm^2$ and 0.2% proof stress above 300 $N/mm^2$ after undergoing annealing in order to press mold the flat mask as outlined above while maintaining an average thermal expansion coefficient below $12\times10^{-7}$/° C. at 30–100° C. When the Young's modulus is above 120,000 $N/mm^2$ and the 0.2% proof stress is above 300 $N/mm^2$, the mask is not deformed even when a totally flat-screen CRT is subjected to the drop shock test outlined above.

The defining characteristic of the present invention lies in taking as its basis an Fe—Ni alloy with a reduced amount of added Mn, having a low thermal expansion coefficient, to which are added appropriate amounts of Co, and also Nb, Ta and/or Hf, as additional base elements to raise the proof stress and Young's modulus so as to increase drop shock resistance, and hot rolling the alloy at a distortion rate of below 70/second for each pass in order to avoid formation of edge and surface cracks. Cracks form because the distortion applied to the material in each pass accumulates without being relieved. It has been discovered that when the distortion rate is kept below 70/second in each pass, then the distortion applied to the material in each pass is relieved by the heat, thus allowing hot rolling to proceed without crack formation. The conventional method of controlling the reduction ratio alone is insufficient in preventing crack formation.

The distortion rate for each pass of rolling is obtained by the formula: distortion during processing/duration of rolling. This is shown in the drawing wherein, when the material is rolled at rolling speed V (m/min) through the hot rollers to be flattened from a thickness of t0 to t1, the distortion during processing (C) is determined by:

$$\epsilon=1n(t0/t1)$$

The duration of rolling (h) is determined by:

$$h=\text{length of rolling } (L)/\text{rate of rolling } (V)$$

Length of rolling (length of arc AB) is obtained by:

$$L=2\pi r(\theta/360)$$

where r is the radius of the roller, and θ is the corresponding angle of arc AB. θ can be calculated as follows:

$$\cos^{-1}((r-(t0-t1)/2)/r)$$

Below, are listed the constituent elements of the alloy of in the current invention and the specified conditions for processing the alloy, giving explanations for each.

Base Elements

Ni: To prevent the formation of harmful compounds, such as martensite, and to achieve low thermal expansion through a multiplier effect with Co, Ni should comprise 33–37% of the alloy, and preferably 34–36%.

Co: In addition to lowering thermal expansion, Co also improves proof stress. In order to achieve this effect, a minimum amount of 0.01% is considered necessary, but on the other hand, if over 2% is included, then the thermal expansion of the alloy will increase, depending on the balance between the amount of Ni and Co. Furthermore, increasing the amount of Co also increases the cost of manufacturing. In general when the amount of Ni is high (over 35.5%), it is possible to limit the amount of Co to the miniscule amount of below 0.01%, and it may even be possible not to add any Co at all. Therefore we have listed this element as one to be added optionally, but for the purposes of the current invention, it is desirable to add Co in the range of 0.01–2%, preferably 0.5–2%.

Mn: Added as a deoxidization agent, but its addition increases thermal expansion, so that in order to achieve an average thermal expansion coefficient below $12\times10^{-7}$/° C. at 30–100° C., the amount must be 0.001–0.1%, preferably 0.001–0.05%.

Additional Elements

Nb, Ta, Hf: Without increasing thermal expansion, these elements increase proof stress by a multiplier effect in conjunction with Co, and also improve the Young's modulus. They are not effective in amounts below 0.01%, but if the amount goes above 0.8%, the material becomes difficult to etch, as well as having an increased thermal expansion. Not only must these elements be kept in the range of 0.01–0.8% individually, but the combined amount of these elements must also stay within this range.

Impurities

C: At amounts over 0.01%, C produces excessive carbide, making the material difficult to etch; it is therefore desirable that the amount be kept below 0.01%, and preferably below 0.006%.

Si: Has a deoxidizing effect, but at above 0.02%, Si has a great negative impact on the ease of etching; therefore it is preferred that the amount be kept below 0.02%.

P: Excessive amounts of P lead to difficulty in etching material; therefore the desirable amount is below 0.01%, and preferably below 0.005%.

S: At above 0.01%, S interferes with the workability of the alloy during hot processing, and also causes a negative impact on the ease of etching due to an increase in sulfide inclusion; therefore it is desirable to keep the amount below 0.01% at the most, and preferably below 0.005%.

N: Forms compounds with Nb, Ta and Hf, and diminishes the workability of the alloy during hot rolling, as well as diminishes the ease of etching; therefore it is desirable that the amount of N be below 0.005%, preferably below 0.003%.

For example, MnS and P segregates are ductile, and stretch in streaks through the material after rolling. These then cause disfigurement in the edges of holes or slots etched into the material. Therefore, in order not to impact negatively on the ease of etching, the amount of these and like impurities must be controlled.

Conditions for Processing

Distortion rate during hot rolling: When the distortion rate during each pass of rolling surpasses 70/sec, the distortion applied to the material during each pass accumulates without being relieved, leading to crack formation. When the distortion rate is below 70/sec, the distortion applied to the material in each pass is relieved by the heat, thus allowing hot rolling to proceed without crack formation. However, if the distortion rate falls below the 10/sec, the rate of production suffers; therefore it is desirable that the rolling be performed at above 10/sec distortion rate.

Temperature of material before hot rolling: If the temperature at which the material is heated before hot rolling and the duration of heating, are below 1000° C. and 0.5 hours, then the material is not heated sufficiently, and is not pliable enough to be hot rolled, and in addition there is not enough heat for the material to recover from the distortion it is subjected to during the passes, leading to formation of edge and surface cracks. If the temperature at which the material is heated and the duration of heating surpasses 1300° C. and 10 hours, then the material might oxidize, and also the cost of heating becomes excessive. Therefore, the material is heated at temperatures between 1000–1300° C. for between 0.5 and 10 hours.

Temperature of material during final hot rolling pass: The heated material is flattened to the desired thickness after going through several passes of hot rolling, but attempting to roll the material after its temperature falls below 600° C. leads to excessive crack formation; thus, it is crucial that the rolling be conducted in such a manner that the temperature of the material during the final pass remains above 600° C.

Below are examples demonstrating the importance of alloy composition in the alloy used in the current invention, and examples and comparisons demonstrating the importance of the distortion rate.

EXAMPLE 1

Table 1 shows examples of alloys manufactured as stated in the current invention, and comparison examples of alloys manufactured otherwise. These alloys were melted in vacuum induction furnaces (VIM), cast, forged and hot rolled into 3 mm thickness, then subjected to repeated cold rolling and bright annealment to a thickness of approximately 0.12 mm. The material thus obtained was then slitted into the determined width for shadow masks, annealed in a reduction atmosphere (900° C.×30 min in hydrogen) and press molded.

TABLE 1

| Alloy No. | Ni | Mn | C | Si | P | S | N | Co | Nb | Ta | Hf |
|---|---|---|---|---|---|---|---|---|---|---|---|
| 1 | 36.1 | 0.01 | 0.004 | 0.01 | 0.002 | 0.001 | 0.0025 | <0.01 | 0.31 | <0.001 | <0.001 |
| 2 | 35.8 | 0.08 | 0.003 | 0.01 | 0.002 | 0.001 | 0.0027 | <0.01 | 0.35 | <0.001 | <0.001 |
| 3 | 34.1 | 0.03 | 0.003 | 0.01 | 0.003 | 0.001 | 0.0030 | 1.55 | 0.29 | <0.001 | <0.001 |
| 4 | 34.5 | 0.08 | 0.004 | <0.01 | 0.002 | 0.001 | 0.0027 | 0.90 | 0.26 | <0.001 | <0.001 |
| 5 | 35.8 | 0.04 | 0.003 | 0.02 | 0.003 | 0.002 | 0.0019 | <0.01 | <0.001 | 0.32 | <0.001 |
| 6 | 36.1 | 0.02 | 0.005 | <0.01 | 0.002 | 0.001 | 0.0020 | <0.01 | <0.001 | <0.001 | 0.27 |
| 7 | 35.7 | 0.02 | 0.004 | 0.01 | 0.003 | 0.001 | 0.0032 | 0.80 | 0.21 | 0.12 | <0.001 |
| 8 | 35.5 | 0.05 | 0.003 | <0.01 | 0.002 | 0.002 | 0.0018 | <0.01 | 0.18 | 0.12 | 0.10 |
| 9 | 36.0 | 0.05 | 0.003 | 0.01 | 0.002 | 0.003 | 0.0022 | <0.01 | <0.001 | 0.20 | 0.25 |
| 10 | 34.4 | 0.02 | 0.003 | 0.01 | 0.002 | 0.001 | 0.0033 | 1.40 | 0.13 | 0.14 | 0.13 |
| 11 | 34.4 | 0.02 | 0.004 | 0.01 | 0.002 | 0.020 | 0.0030 | 1.65 | 0.29 | <0.001 | <0.001 |
| 12 | 35.4 | 0.03 | 0.018 | 0.01 | 0.002 | 0.002 | 0.0022 | 0.90 | <0.001 | 0.35 | <0.001 |
| 13 | 34.6 | 0.04 | 0.003 | 0.11 | 0.003 | 0.002 | 0.0035 | 1.55 | <0.001 | <0.001 | 0.45 |
| 14 | 36.2 | 0.03 | 0.004 | <0.01 | 0.020 | 0.001 | 0.0040 | <0.01 | 0.37 | 0.15 | <0.001 |
| 15 | 35.9 | 0.02 | 0.003 | <0.01 | 0.003 | 0.003 | 0.0072 | 0.90 | 0.30 | <0.001 | 0.20 |
| Comparison Examples | | | | | | | | | | | |
| 16 | 36.0 | 0.32 | 0.003 | 0.01 | 0.003 | 0.002 | 0.0025 | <0.01 | 0.31 | 0.17 | 0.15 |
| 17 | 35.7 | 0.03 | 0.004 | 0.01 | 0.002 | 0.003 | 0.0032 | 3.35 | 0.29 | <0.001 | <0.001 |
| 18 | 35.5 | 0.03 | 0.004 | <0.01 | 0.002 | 0.002 | 0.0037 | <0.01 | <0.001 | <0.001 | <0.001 |
| 19 | 32.1 | 0.03 | 0.003 | <0.01 | 0.003 | 0.001 | 0.0029 | <0.01 | 0.35 | 0.15 | <0.001 |
| 20 | 38.9 | 0.05 | 0.003 | 0.01 | 0.002 | 0.001 | 0.0033 | <0.01 | <0.001 | 0.35 | <0.001 |
| 21 | 36.3 | 0.03 | 0.004 | 0.01 | 0.002 | 0.002 | 0.0029 | <0.01 | 0.40 | 0.70 | <0.001 |
| 22 | 35.9 | 0.02 | 0.002 | <0.01 | 0.003 | 0.002 | 0.0035 | 1.50 | 0.29 | 0.35 | 0.40 |

After annealing as above, the materials were subjected to tensile testing to measure tensile strength and 0.2% proof stress. "Bending vibration" tests following procedures outlined in "JIS R 1605" were also conducted to measure Young's modulus at room temperature.

In the "bending vibration" test, a test specimen is suspended by a string between a driving mechanism and a measuring mechanism so that the specimen can vibrate freely; then a driving force from an oscillator is applied from both sides. The maximum amplitude and length of vibration are measured by the measuring mechanism, from which primary resonance frequency is determined. Dynamic modulus of elasticity is then calculated from the primary resonance frequency, dimension and mass of the test specimen based on the prescribed formula.

In addition, the average thermal expansion coefficient was measured at 30–100° C.

The surface of the test specimen was sprayed with a 45 Baumé aqueous solution of ferric chloride at 60° C. under a pressure of 0.3 MPa, and observations were conducted of the etched surfaces.

The results are shown in Table 2 which contains for each alloy the Tensile Strength (Tens. Str.) in $N/mm^2$, the 0.2% Proof Stress (0.2% Pr. Str.) in $N/mm^2$, the Young's Modulus (Young's Mod.) in $N/mm^2$, the Average Thermal Expansion (measured range 30–100° C.)$\times 10^{-7}$/° C. (Coeff. of Exp.$\times 10^{-7}$/° C.) and Condition of Etched Surface (Cond. Surf.). For each value other than tensile strength, an assessment of the property is indicated by the following signs:

○—good/meets criteria

Δ—mediocre

X—unsatisfactory/ does not meet criteria

TABLE 2

| Alloy No. | Tens. Str. $N/mm^2$ | 0.2 Pr. Str. $N/mm^2$ | Young's Mod., $N/mm^2$ | Coeff. Of Exp. $\times 10^{-7}$/° C. | Cond. Surf. |
|---|---|---|---|---|---|
| Invention Examples | | | | | |
| 1 | 485 | 332 (○) | 133000 (○) | 9.5 (○) | (○) |
| 2 | 494 | 338 (○) | 134000 (○) | 9.8 (○) | (○) |
| 3 | 497 | 340 (○) | 135000 (○) | 8.6 (○) | (○) |
| 4 | 490 | 335 (○) | 134000 (○) | 8.9 (○) | (○) |
| 5 | 480 | 330 (○) | 132000 (○) | 9.7 (○) | (○) |
| 6 | 475 | 330 (○) | 133000 (○) | 9.5 (○) | (○) |
| 7 | 500 | 345 (○) | 136000 (○) | 9.2 (○) | (○) |
| 8 | 505 | 340 (○) | 139000 (○) | 9.9 (○) | (○) |
| 9 | 510 | 350 (○) | 140000 (○) | 10.2 (○) | (○) |
| 10 | 528 | 365 (○) | 145000 (○) | 11.2 (○) | (○) |
| 11 | 490 | 330 (○) | 132000 (○) | 9.2 (○) | Δ |
| 12 | 530 | 370 (○) | 143000 (○) | 8.8 (○) | Δ |
| 13 | 495 | 340 (○) | 139000 (○) | 10.0 (○) | Δ |
| 14 | 500 | 340 (○) | 140000 (○) | 10.4 (○) | Δ |
| 15 | 525 | 368 (○) | 142000 (○) | 10.9 (○) | Δ |
| Comparison Examples | | | | | |
| 16 | 540 | 378 (○) | 146000 (○) | 15.2 (X) | (○) |
| 17 | 520 | 348 (○) | 141000 (○) | 13.9 (X) | (○) |
| 18 | 430 | 279 (X) | 115000 (X) | 8.0 (○) | (○) |
| 19 | 495 | 336 (○) | 133000 (○) | 28.0 (X) | (○) |
| 20 | 480 | 325 (○) | 134000 (○) | 35.5 (X) | (○) |
| 21 | 555 | 380 (○) | 145000 (○) | 14.4 (X) | (X) |
| 22 | 565 | 388 (○) | 145000 (○) | 15.6 (X) | (X) |

Alloys Nos. 1–10 within the current invention, achieve the desired levels of Young's modulus (above 120,000 $N/mm^2$) and 0.2% proof stress (above 300 $N/mm^2$) without exceeding the allowable range in thermal expansion coefficient ($12\times10^{-7}$/° C.). Alloys 9 and 10, in particular, simultaneously achieved a Young's modulus above 140,000 $N/mm^2$and 0.2% proof stress of above 350 $N/mm^2$. The amount of Mn and impurities were also in the acceptable range, and the condition of etched surface was excellent.

Also, alloys No. 11–15, which are within the current invention, contain impurities S, C, Si, P and N, respectively, above the desirable range, therefore causing a degradation of quality in the etched surface, but this presented no problems in use. They achieved acceptable ranges in 0.2% proof stress, Young's modulus and thermal expansion coefficient.

In contrast, alloy No. 16 contains Mn in excess of 0.1%, and the average thermal expansion coefficient is therefore high. Alloy No. 17 contains Co in excess of 2.0%, and in relation to the balance with the contained amount of Ni, therefore the average thermal coefficient is high. Nb, Ta and Hf were not added to alloy No. 18, making it extremely lacking in strength. In alloys Nos. 19–20, the amounts of contained Ni fall outside the range of 33–37%; therefore the average thermal expansion coefficient is high. Alloy No. 21 contains Nb and Ta in excess of 0.8%, and in alloy No. 22, the combined total of Nb, Ta and Hf exceeds 0.8%, so therefore the average thermal expansion coefficient is high, and in addition the condition of the etched surface was unacceptable.

EXAMPLE 2

Table 3 shows the composition of alloys related in the current invention which were used for hot working tests. Alloys 1–6 all meet the composition range requirements laid out in the current invention, including levels of impurities.

TABLE 3

| Alloy No. | Ni | Mn | S | C | Si | P | N | Co | Nb | Ta | Hf | Mn/S |
|---|---|---|---|---|---|---|---|---|---|---|---|---|
| 1 | 36.1 | 0.01 | 0.001 | 0.003 | 0.01 | 0.002 | 0.0020 | 0.01 | 0.31 | <0.001 | <0.001 | 10.0 |
| 2 | 35.8 | 0.05 | 0.002 | 0.004 | 0.02 | 0.003 | 0.0027 | 0.02 | 0.35 | 0.12 | <0.001 | 25.0 |
| 3 | 34.2 | 0.03 | 0.002 | 0.003 | 0.02 | 0.003 | 0.0019 | 1.8 | 0.29 | 0.14 | 0.13 | 15.0 |
| 4 | 35.5 | 0.01 | 0.002 | 0.005 | 0.01 | 0.006 | 0.0030 | 0.02 | 0.40 | 0.16 | <0.001 | 5.0 |
| 5 | 35.9 | 0.03 | 0.002 | 0.004 | 0.02 | 0.002 | 0.0022 | 0.01 | 0.31 | <0.001 | <0.001 | 15.0 |
| 6 | 36.1 | 0.02 | 0.002 | 0.005 | <0.01 | 0.003 | 0.0024 | 0.01 | 0.35 | 0.15 | 0.10 | 10.0 |

The alloys composed as in Table 3 above were melted in a vacuum induction furnace (VIM) and cast into ingots. The ingots were forged and cut into hot working test specimens (cylindrical bars 10 mm in diameter).

Each specimen was mounted in a hot working test device (a device which conducts tests similar to tensile tests under high temperature conditions), and tests were conducted with varying heating temperature, heating time, and distortion rate. Distortion rate was derived from the distortion during single pass and the duration of the pass. Heating time is the amount of time the material was left in the heating furnace.

After testing, the surface of the specimen were inspected visually. In addition, the cross section of the specimen (the surface perpendicular to the one on which the load was applied) was also examined. Specimens which did not have cracks above 1 mm in depth were marked ◎, specimens with cracks from –2 mm were marked ○, and specimens which developed cracks deeper than 3 mm were marked X. The results are shown in Table 4 which contains for each alloy the Heating Temperature (Htg. Temp.) in ° C. the Heating Time (Htg. Time) in hours, the Distortion Rate (Dist. Rate) in /sec, the Hot Working Temperature emp.) in ° C. and the Presence of Cracks (Pres. Crks.).

TABLE 4

| Case No. | Alloy No. | Htg. Temp. ° C. | Htg. Time hrs. | Dist. Rate/Sec | Ht. Wkg. Temp., ° C. | Pres. Crks. |
|---|---|---|---|---|---|---|
| Current Invention Examples A | | | | | | |
| 1 | 1 | 1200 | 2.0 | 50 | 950 | ◎ |
| 2 | 2 | 1250 | 1.5 | 40 | 870 | ◎ |
| 3 | 3 | 1200 | 2.0 | 65 | 1000 | ◎ |
| 4 | 2 | 1100 | 1.0 | 50 | 650 | ◎ |
| 5 | 3 | 1150 | 2.5 | 20 | 830 | ◎ |
| 6 | 4 | 1050 | 3.0 | 60 | 700 | ◎ |
| 7 | 4 | 1150 | 2.0 | 60 | 850 | ◎ |
| 8 | 3 | 1200 | 7.5 | 60 | 870 | ◎ |
| Current Invention Examples B | | | | | | |
| 9 | 1 | 800 | 1.0 | 60 | 700 | ○ |
| 10 | 2 | 850 | 2.0 | 60 | 760 | ○ |
| 11 | 1 | 1200 | 0.2 | 50 | 750 | ○ |
| 12 | 3 | 1100 | 0.3 | 30 | 700 | ○ |
| 13 | 1 | 1200 | 1.5 | 35 | 550 | ○ |
| 14 | 2 | 1050 | 2.0 | 50 | 550 | ○ |
| 15 | 3 | 1100 | 2.0 | 45 | 550 | ○ |
| Comparison Examples | | | | | | |
| 16 | 1 | 1200 | 2.0 | 90 | 950 | X |
| 17 | 2 | 1250 | 1.5 | 100 | 900 | X |
| 18 | 3 | 1200 | 2.0 | 120 | 1000 | X |
| 19 | 4 | 900 | 2.0 | 90 | 550 | X |

With Current Invention Examples A (Case Nos. 1–8) not only the distortion rate, but heating temperature, heating time and hot working temperature were all within the range specified by the current invention. No cracks deeper than 1 mm developed. (◎).

With Current Invention Examples B (Case Nos. 9–15), the distortion rate was below 70/sec, but in Nos. 9–10, heating temperature was below the specified range; in Nos. 11–12, heating time was shorter than specified range; and in Nos. 13–15, hot working temperature was low. Cracks were noted, but they were slight, remaining between 1–2 mm in depth, and did not affect practical use. (○)

In Comparison Examples Nos. 16–18, the distortion rate was outside the specified range, causing cracks deeper than 3 mm. (X) Comparison Example No. 19 had a distortion rate and hot working temperature that both fell outside the range of the current invention, and cracks deeper than 3 mm were observed. (X)

Field Testing

In addition to the foregoing tests, hot rolling was performed at various distortion rates on the actual hot roller [used in production], and a check was performed on the presence of cracks. The distortion rate is adjusted by adjusting the rolling speed and the rolling draft.

Alloy No. 5 and No. 6 were hot rolled on the actual roller with conditions set as in Examples A, B, C and D shown in Table 5. The material was rolled from a thickness of 150 mm to 3 mm in 14 passes.

Examples that did not have edge cracks deeper than 5 mm upon visual observation and did not have surface cracks longer than 3 mm upon visual inspection after pickling were rated ◎. Those that occasionally developed cracks 2–4 mm deep, where the cracks were slight and did not affect practical use were rated ○. Those that developed edge cracks deeper than 5 mm and surface cracks longer than 10–30 mm were rated X. The result of these evaluations of hot workability, performed on the actual hot roller, are shown in Table 5, wherein Column 1 is Field Text Example Number (Fld. Tst. Ex. No.) and Columns 2–7 are Alloy No., Heating Temperature, Heating Time, Distortion Rate, Hot Working Temperature and Presence of Cracks with the same abbreviated column headings and units as shown in Table 4.

TABLE 5

| Fld. Tst. Ex. | Alloy No. | Htg. Temp. ° C. | Htg. Time Hrs | Dist. Rate/sec | Ht. Wkg. Temp. | Pres. Crks. |
|---|---|---|---|---|---|---|
| Current Invention Examples | | | | | | |
| A | 5 | 1150 | 1.5 | 65 | 900 | ◎ |
| B | 6 | 1200 | 2.0 | 60 | 820 | ◎ |
| Comparison Examples | | | | | | |
| C | 5 | 1150 | 1.5 | 110 | 870 | X |
| D | 6 | 1200 | 2.0 | 90 | 800 | X |

Examples A and B meet the conditions of the current invention, and therefore no edge or surface cracks were confirmed. With comparison examples C and D, the maximum value of the distortion rate during each hot rolling pass are 110/sec and 90/sec respectively, exceeding the rate specified by the current invention, and edge cracks deeper than 5–10 mm and surface cracks longer than 10–30 mm were confirmed upon inspection after pickling.

We note that in this round of testing, no examples of cases with slight cracks 24 mm deep that do not affect practical use (○) were observed.

With this invention, it has become possible to efficiently manufacture Fe—Ni alloys in the form of press molded flat masks by using a Fe—Ni alloy containing appropriate amounts of nickel in which the amount of contained Mn is maintained at a low level and to which is added the appropriate amount of Co in order to achieve low thermal expansion at the same time Nb, Ta and/or Hf are added in appropriate amounts to increase resistance to drop shock, and by limiting the formation of edge and surface cracks during hot rolling due to an improvement the hot workability of this material resulting from employment of the most favorable conditions for hot rolling.

Thus, it has become possible to reliably and efficiently manufacture press molded flat masks appropriate for use in a flat-type color CRT, which cause no color distortion and do not become misshapen during handling.

I claim:

1. A method of manufacturing an Fe—Ni alloy consisting of 33–37% Ni; 0.001–0.1% Mn; optionally, 0.01–2% Co; and at least one of 1) 0.01–0.8% Nb; 2) 0.01–0.8% Ta; and/or 3) 0.01–0.8% Hf; with the total of Nb, Ta, and Hf being in the range of 0.01–0.8%, and the remainder being Fe and unavoidable impurities, said method comprising subjecting said alloy to a hot rolling process wherein the rate of distortion during each pass of hot rolling is below 70/second resulting in the alloy having a reduced rate of crack formation during such hot rolling process and high drop shock resistance and low thermal expansion after said hot rolling process.

2. The method of claim 1 wherein the main impurities in said alloy are limited to maximums of 0.01% C, 0.02% Si, 0.01% P, 0.01% S and 0.005% N.

3. The method of claim 1 or 2 wherein said alloy is heated at a temperature of 1000 to 1300° C. for 0.5 to 10 hours before hot rolling.

4. The method of claim 1 or 2 wherein the final pass of hot rolling is preformed with the temperature of the alloy above 600° C.

* * * * *